US006966347B2

(12) United States Patent
Teutsch et al.

(10) Patent No.: US 6,966,347 B2
(45) Date of Patent: Nov. 22, 2005

(54) METHOD AND DEVICE FOR TANK LEAKAGE DIAGNOSIS AT ELEVATED FUEL DEGASSING

(75) Inventors: Sven Teutsch, Ludwigsburg (DE); Peter Wiltsch, Wimsheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/479,781

(22) PCT Filed: May 28, 2002

(86) PCT No.: PCT/DE02/01967

§ 371 (c)(1),
(2), (4) Date: Sep. 1, 2004

(65) Prior Publication Data

US 2005/0005682 A1 Jan. 13, 2005

(30) Foreign Application Priority Data

May 30, 2001 (DE) ..... 101 26 521
Aug. 24, 2001 (DE) ..... 101 41 600

(51) Int. Cl.[7] ..... B65B 1/04
(52) U.S. Cl. ..... 141/83; 123/520
(58) Field of Search ..... 141/65, 66, 83, 141/192; 123/516–520, 198 D

(56) References Cited

U.S. PATENT DOCUMENTS 5,349,935 A 9/1994 Mezger et al.
5,396,873 A 3/1995 Yamanaka et al.

FOREIGN PATENT DOCUMENTS

| | | |
|---|---|---|
| DE | 196 25 702 | 1/1998 |
| DE | 196 36 431 | 3/1998 |
| DE | 198 09 384 | 9/1999 |
| EP | 0 750 108 | 12/1996 |
| JP | 07 042631 | 6/1995 |
| JP | 09 177617 | 11/1997 |

*Primary Examiner*—Steven O. Douglas
(74) *Attorney, Agent, or Firm*—Kenyon & Kenyon

(57) ABSTRACT

A method for operating a tank leakage diagnosis device, especially of a motor vehicle, volatile fuel (to be degassed) being temporarily stored using an adsorption filter of known absorption capacity or absorption characteristics, and the adsorption filter being regenerated from time to time by purging, using fresh air, to avoid faulty measurements in the tank leakage diagnosis, in particular at elevated fuel degassing. It is provided that the adsorption filter be purged, and, in this context, the volatile fuel removed from the adsorption filter over a predefined time span be integrated, and from that, the loading of the adsorption filter with the volatile fuel, changing during the time span, is ascertained, from the absorption capacity and the absorption characteristics of the adsorption filter, as well as the integrated fuel quantity or the changing loading. The quantity of fuel to be degassed supplied to the adsorption filter from the fuel container in the time span is calculated, and, as a function of the calculated quantity of fuel supplied to the adsorption filter, an intervention is undertaken at the tank leakage diagnosis device.

15 Claims, 3 Drawing Sheets

METHOD AND DEVICE FOR TANK LEAKAGE DIAGNOSIS AT ELEVATED FUEL DEGASSING

FIELD OF THE INVENTION

The present invention relates to a method for operating a tank leakage diagnosis device, particularly of a motor vehicle. In addition, the present invention relates to a control unit and a tank leakage diagnosis unit for carrying out the method.

BACKGROUND INFORMATION

In a fuel storage tank of a motor vehicle that contains fuel, volatile hydrocarbons are continuously escaping. This effect increases with temperature and the agitation or sloshing of the fuel. In motor vehicles driven by internal combustion engines, for a flawless fuel supply, venting of the fuel storage tank is absolutely essential. For, as fuel is used up, air has to be able to flow in behind it, since otherwise a vacuum would form in the tank, and the fuel flow would come to a stop. However, the tank also has to be vented so as to give the tank's contents sufficient opportunity to expand as it warms up. Also, when the tank is filled up, sufficient air has to be able to exit the tank so that the fuel being filled up does not bubble out of the filler pipe again.

Therefore, in such vehicles, increasingly tank venting systems are used in which the evaporating and excess fuel vapor is guided not into the open air but, via a venting line, into an active charcoal filter (AKF). This fuel vapor is stored temporarily in the AKF, and, during the operation of the motor vehicle, is guided via a clocked activatable electromagnetic tank venting valve (TEV) to the intake manifold of the internal combustion engine, and thus to combustion. This prevents emission of the environmentally harmful fuel vapors from the tank into the environment to the greatest extent, and at the same time the vapors supplied to the internal combustion engine are themselves used as fuel, whereby fuel usage is considerably reduced.

Based on the limited absorption volume of the active charcoal used in the AKF, one should intermittently regenerate the AKF. In order to do this, while the internal combustion engine is running, fresh air is drawn in via the AKF, and the fuel vapor removed in the process is supplied to the internal combustion engine as a mixture for combustion. The respective flushing quantity is controlled by the TEV via a performance characteristics adaptation using the parameters load and rotary speed, so that the running properties of the internal combustion engine are not impaired. A lambda control additionally monitors and regulates the regeneration. The lambda deviation resulting from this can then be drawn upon as a measurement of the loading state of the AKF.

In this connection, intensified legal regulations on the operation of internal combustion engines will apply in the future in some countries, such as the USA. Thereafter, it will be required for motor vehicles, in which volatile fuels like gasoline are used, that a possibly existing leakage in the entire fuel tank system be tracked down using an on-board arrangement.

Corresponding methods and devices for tank leakage diagnosis in a tank venting system of a motor vehicle are referred to, for example, in the U.S. Pat. No. 5,349,935, DE 196 36 431.0 A1, DE 198 09 384.5 A1 and DE 196 25 702 A1. In these, an overpressure is applied to the tank venting system, and a conclusion as to the presence of a leak is drawn from the subsequent course of the pressure. In the system of DE 196 36 431.0 A1, one may form a ram pressure between a pump and a reference leak, whereby the pump's rotary speed is lowered and the pump's current consumption increases. If the tank is leakproof, a higher pressure develops than when against the reference leak. The current consumption is consequently higher.

It may be observed that the tank leak diagnosis, instead of by the use of overpressure, may also be performed with the aid of underpressure.

A relatively high fuel degassing leads to erroneous measurements in tank leakage diagnosis. Therefore, as a measure of increased fuel degassing, a filtered loading factor of the AKF is used as a basis. The loading factor is calculated during travel, and filtered via a time constant. To do this, with the engine running, the TEV is controlled to open, and the deviation coming about in the lambda regulator, in this context, is recorded. Using the recorded deviation, together with the volume stream through the TEV that is also present in the engine control, the hydrocarbon (HC) concentration of the drawn in flushing volume stream is calculated. The HC concentration of the air drawn in through the AKF thus ascertained is valid as the measure of the magnitude of the AKF's loading. If the loading value exceeds a predefined threshold, the leakage diagnosis is interrupted or temporarily blocked.

Since the loading is a function not only of the magnitude of the fuel degassing, using the loading value alone no accurate statement can be made concerning the actual magnitude of the instantaneous degassing. Thus, even at a very great fuel degassing under certain travel conditions, the loading factor may be artificially kept low using a high purging rate. In such a case, the leakage diagnosis would be enabled because of the low loading factor and the low degassing supposed from this. In actual fact, however, because of the actually present high degassing, this would lead to erroneous results in the leakage diagnosis. In the case of the overpressure diagnosis method discussed above, the leakage quantities specified by law in the USA would not be met. In the underpressure methods also named, such an erroneous detection may lead to the mistaken diagnosis of a non-leakproof tank system.

SUMMARY OF THE INVENTION

Therefore, the exemplary method of the present invention is intended to avoid erroneous measurements in tank leakage diagnosis, particularly at elevated fuel degassing.

The exemplary embodiment and/or exemplary method of the present invention is based on ascertaining the actual instantaneously present fuel degassing, and, as a function of the ascertained degassing value, of suppressing affected diagnosis functions in order thereby to avoid false diagnoses. According to one variant, a substantial improvement in the quality of the diagnosis may be brought about, depending on the diagnosis function affected, by compensation of the disturbance measured by the degassing present during the tank leakage diagnosis.

For this, the exemplary method according to the present invention provides that the adsorption filter be flushed, and in this context, the volatile fuel removed over a predefined time span from the adsorption filter be integrated, and from that there be ascertained loading of the adsorption filter with the volatile fuel that changes within the time span, that from the adsorption capacity or adsorption characteristics of the adsorption filter, the loading factor made available as well as the integrated fuel quantity or the changing loading, the quantity of degassing fuel supplied to the adsorption filter from the fuel container in the time span be calculated, and, as a function of the calculated quantity of the fuel supplied to the adsorption filter, an intervention is undertaken at the tank leakage diagnosis unit. According to this, a balance calculation is carried out or performed from which a conclusion is drawn on the fuel mass supplied to the adsorption filter from the fuel mass removed during the purging of the adsorption filter. In this context, the fuel mass supplied to the adsorption filter is assumed to be the actual degassing mass.

In a first variant it is provided that at least one leakage diagnosis function is interrupted or blocked as a function of the calculated quantity of degassing fuel. According to a second variant, also as a function of the calculated quantity of degassing fuel, there takes place an immediate, or possibly time-delayed, compensation of the disturbance in the tank leakage diagnosis conditioned upon the calculated quantity of degassing fuel.

The interventions, at the tank leakage diagnosis device mentioned, take place either in response to each present calculated value, in the way of a compensation, or in each case only when the calculated quantity of degassing fuel exceeds a predefinable threshold value.

DETAILED DESCRIPTION

Figure 1:
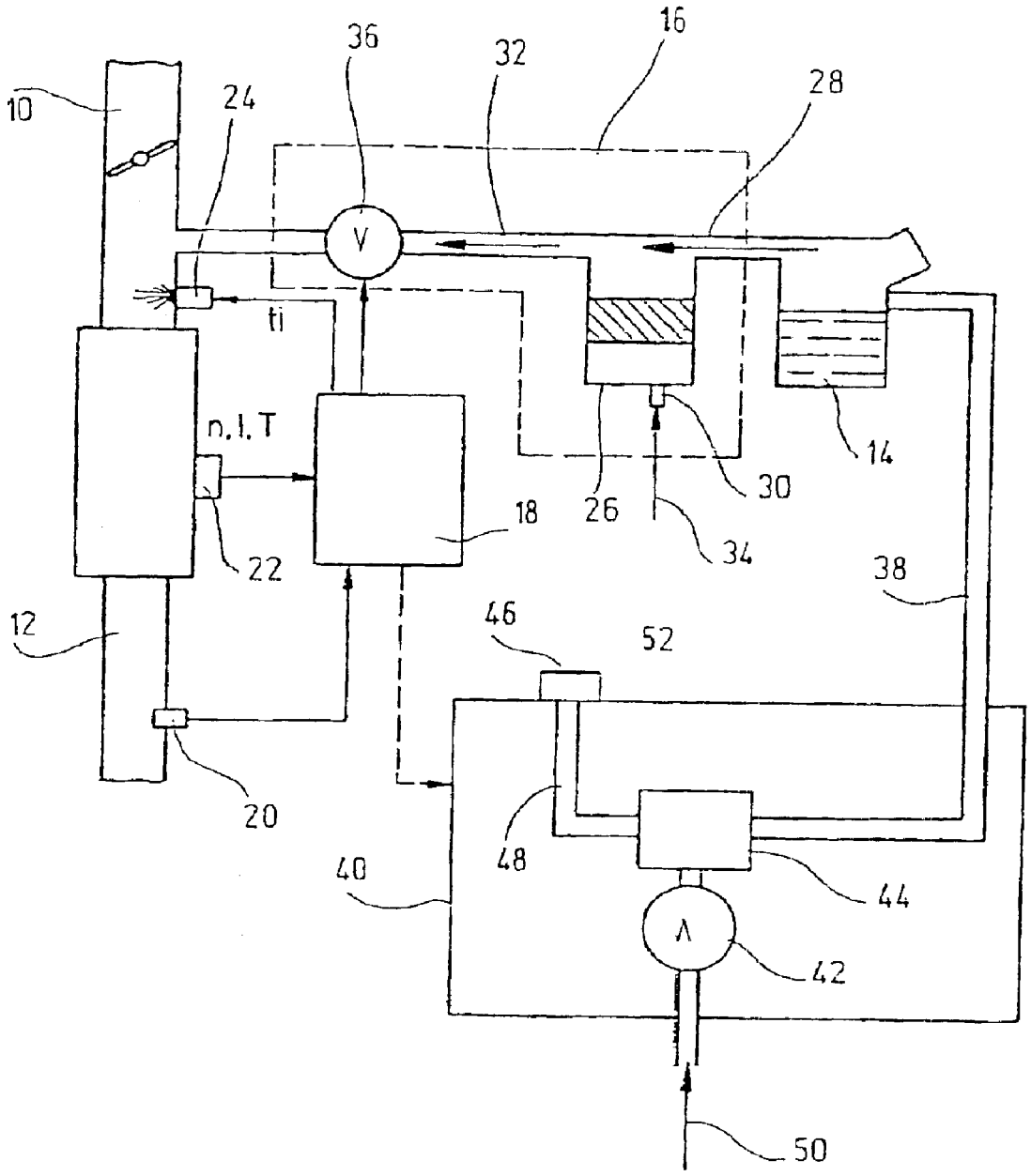
FIG. 1 shows a fuel tank system of a motor vehicle, in which the exemplary method according to the present invention is used.

FIG. 1 shows an intake manifold 10 that may be provided in a (not shown) internal combustion engine (BKM) especially of a motor vehicle, as well as an exhaust gas tract 12. A fuel storage tank 14 is provided for fuel storage.

For the low-emission operation of the BKM, there are provided a tank venting device 16, a control unit 18, an exhaust gas sensor system 20, as well as a sensor system 22, which takes the place of a plurality of sensors ascertaining operating parameters of the BKM, such as a rotary speed sensors, flow meters for sensing the intake air quantity, temperature sensors, etc. The device shown also provides a fuel metering device 24, which, for instance, may be implemented as equipment for one or more injection valves.

Tank venting (ventilation) device 16 includes an active charcoal filter (AKF) 26, which communicates via corresponding lines 28–32 with tank 14, environmental air 34 and intake manifold 10 of BKM. The corresponding gas flow directions are indicated by arrows. In line 32 going to intake manifold 10, there is a tank venting valve (TEV) 36.

AKF 26 stores just evaporating fuel in tank 14. As TEV 36 is opened by control device 18, air 34 is drawn in from the environment through AKF 26, which at the same time releases the stored fuel into drawn-in air 34. This fuel/air mixture denoted as "tank venting mixture" or also as "regenerating gas" (called "HC mass" below) now influences the composition of the gas mixture supplied altogether to the BKM, which is also determined by a metering of fuel adjusted to drawn-in air quantity 34 via fuel metering device 24.

In this context, in extreme cases, the fuel supplied to intake manifold 10 via tank ventilating system 16 may constitute a proportion of approximately one-third to one-half of the entire fuel quantity.

During the operation of the motor vehicle or the BKM, or during filling up tank 14, volatile hydrocarbon vapors (HC vapors) form in tank 14, which get into AKF via line 28 and are reversibly bound in it in a known manner. TEV 36 is normally closed. At regular time periods, TEV 36 is controlled via control unit 18 in such a way that a certain partial pressure of the underpressure existing in intake manifold 10 is supplied to AKF 26 via line 32, which leads to the stored HC vapors being drawn from AKF 26 via line 32 and via TEV 36 into intake manifold 10, so as finally to be supplied to BKM for combustion and thus to final disposal. During this process of regeneration of AKF 26, purge air 34 is drawn into AKF26 via line 30, and possibly via a passive filter, whereby the actual purging effect is effected.

For an onboard diagnosis of the operability or tightness of tank 14 or the entire tank system, a leakage diagnosis unit 40 is provided that is connected to tank 14 via a line 38. Leakage diagnosis unit 40 and control unit 18 may be integrated into a single control unit (not shown). Leakage diagnosis unit 40 has a pump 42, which has a switching valve 44 connected upstream of it. A reference leak 46 is situated parallel to line 38. The magnitude of reference leak 46 is selected so that it corresponds to the magnitude of the tank leak that is to be recorded. Switch-over valve 44 has two switch settings. In the first setting, pump 42 is connected to line 48 in a pressure-conducting manner, and then pumps external air 50 all the way through reference leak 46 into line 48. A micro-filter 52 is connected upstream of reference leak 46 towards the outside so as to prevent reference leak 46 becoming blocked by particles possibly drawn in.

The onboard diagnosis named is discussed in detail, for example, in DE 196 36 431.0, to which reference is made and which is incorporated by reference as necessary.

Figure 2:
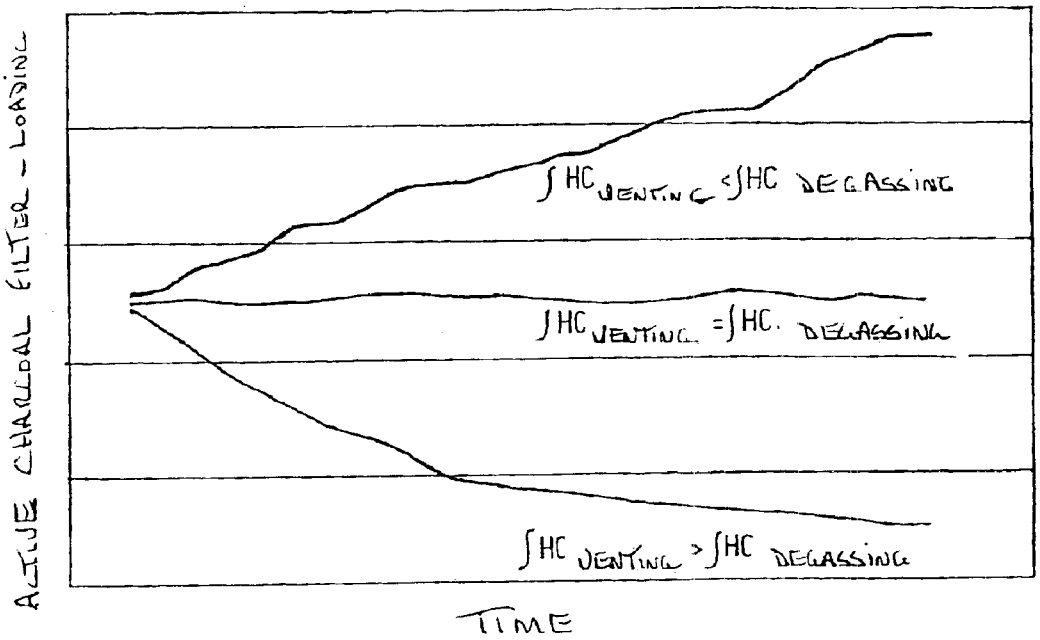
FIG. 2 shows a diagrammatic representation of the time characteristic of the AKF loading at different AKF purging streams.

The premise on which the exemplary method is based will now be shown in the light of FIG. 2. This is made up of a balance calculation which is based on the premise that a fluid level that sets in in the AKF with respect to loading depends, on the HC quantity which is removed from the AKF via the purge stream of the tank ventilation, and on the HC quantity which is supplied to the AKF by the degassing of the fuel. The time characteristic during the transition from the one to the other fluid level on account of a changed degassing or purging quantity depends, in turn, on the adsorption capacity of the AKF.

If, over a certain time span, more HC is removed from the AKF than flows in from the tank, then its fluid level decreases. If, over a certain time span, less HC mass is removed than flows in from the tank, then its fluid level increases. If removal via the tank ventilation and supply from the tank are approximately in balance, then the fluid level also remains nearly constant.

Consequently, as the balance equation one may write:

AKF-HC-loading=the integral(tank_HC-degassing)—the integral (AKF_HC-venting)

The loading factor 'ftead' required for the balance calculation mentioned is already available as the calculated magnitude in the tank ventilation function.

Figure 3:
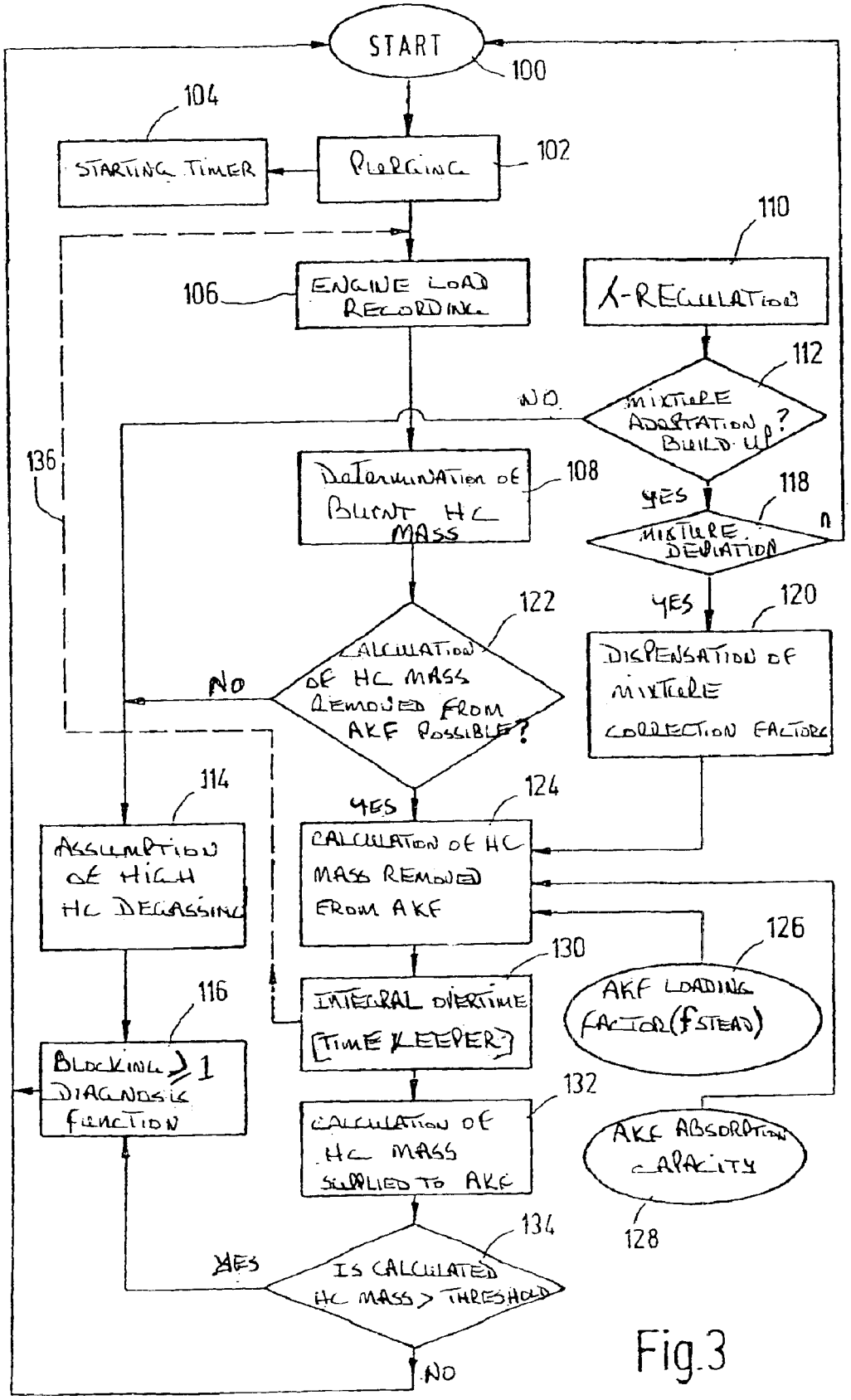
FIG. 3 shows a functional sequence of a control unit according to an exemplary embodiment and/or method of the present invention, as a flow diagram.

FIG. 3 illustrates exemplary functional sequences of a control unit according to the exemplary embodiment and/or exemplary method of the present invention. After start 100 of the routine, a purging of the AKF is brought about 102 via the tank ventilation, and at the same time a timer is started 104 having a zero reading. After that, the instantaneous engine load of BKM is recorded 106. Based on the recorded load, a calculation 108 is carried out of the instantaneous HC mass burned in the BKM. At the same time as the steps mentioned, in the light of a lambda regulation 110 it is determined 112 whether a mixture adaptation carried out in the light of the lambda regulation has built up. If not, an increased or high HC degassing in the tank is assumed 114, and as a result, at least one diagnosis function is blocked 116, or a perhaps already present blocking is confirmed. Alternatively or additionally, by corresponding overcompensation of the actually lower degassing, a false diagnosis may be avoided at the leakage diagnosis unit in the way of a correction. If the mixture adaptation has already built up, it is further checked 118 whether a mixture deviation is present. If not, the system goes back to start 100. Otherwise, mixture correcting factors are recorded 120 that were supplied by the lambda regulation or the engine control The HC quantity removed from the AKF via the purge stream is calculated as exactly as possible. For that purpose, the mixture deviations mentioned, which do not originate from the purge stream of the tank ventilation, are avoided. As in the example, this may occur by waiting until the mixture adaptation has built up. From the fuel calculated in the load recording and required for combustion, and the mixture correction factors from the lambda regulation and the tank ventilating function, the HC mass removed from the AKF via the tank ventilation is calculated in this context and integrated over time.

If a calculation is not possible, the exemplary method is continued with using above-named step 114. Optionally, the further procedure can be made dependent on the mixture adaptation having already built up and there is a mixture deviation. This may be implemented by corresponding flags at steps 112 and 118. If this is the case, the HC mass removed from the AKF is calculated 124, taking under consideration the recorded mixture correction factors 120, as well as the AKF loading factor 'ftead' 126, that has changed in the meantime, and the predefined AKF storage capacity or storage characteristics 128.

The calculated values of the removed HC mass are subsequently integrated over time 130, the instantaneous time calculated by timer 104 in each case being taken as the total time.

In the exemplary embodiment, loading factor 126 is additionally strongly lowpass-filtered to record the instantaneous "AKF liquid level", under the assumption that the actual AKF loading changes only slowly over time. Alternatively, the liquid level may be recorded only at sufficiently constant operating conditions. This should at least better ensure independence from travel-dynamic influences.

The storage capacity of the AKF as well as its "characteristics", i.e. the HC release versus fluid level, and possibly also the dependence of further parameters, such as temperature, or the like, are available, so that using loading factor 126 one may conclude what the AKF fluid level is.

Thereafter, the HC mass supplied to the AKF is calculated from the balance equation (FIG. 2) mentioned 132. This HC volume stream from the tank corresponds to the degassing in the tank. If the calculated HC mass supplied to the AKF exceeds a predefined threshold 134 that is to be empirically determined, then the at least one diagnosis function is blocked 116 or a previously described compensation is carried out or performed by the diagnosis itself.

It should be emphasized that the function cycle shown may, as a rule, run through several times, as indicated by broken line 136, and the values ascertained in each case of the HC mass removed from the AKF are integrated in each case, in this context. In this context, temporal interruptions do not make any difference.

What is claimed is:

1. A method for operating a tank leakage diagnosis device in a motor vehicle, for testing a fuel container, which is connected to an internal combustion engine, for tightness, the method comprising:

regenerating an adsorption filter from time to time by purging by fresh air drawn in by the internal combustion engine, wherein degassing fuel is temporarily stored with an adsorption filter having at least one of an adsorption capacity and adsorption characteristics, the adsorption filter being connected to the fuel container;

providing a loading factor specifying the loading of the adsorption filter with the degassing fuel, wherein the adsorption filter is purged and, in this context, the degassing fuel removed from the adsorption filter over a predefined time span is recorded;

calculating, from at least one of the absorption capacity, the absorption characteristics of the adsorption filter, the loading factor, a recorded, removed fuel quantity and a changing at the loading, an exact quantity of the degassing fuel supplied to the adsorption filter from the fuel container over the predefined time span; and performing, as a function of a determined quantity of the degassing fuel supplied to the adsorption filter, at least one of: (i) one of an interrupting and a blocking of at least one tank leakage diagnosis function, and (ii)a correcting of the data as to an actual tank degassing ascertained with the at least one tank leakage diagnosis function.

2. A method for operating a tank leakage diagnosis device in a motor vehicle, for testing a fuel container, which is connected to an internal combustion engine, for tightness, the method comprising:

regenerating an adsorption filter from time to time by purging by fresh air drawn in by the internal combustion engine, wherein degassing fuel is temporarily stored with an adsorption filter having at least one of an adsorption capacity and adsorption characteristics, the adsorption filter being connected to the fuel container;

providing a loading factor specifying the loading of the adsorption filter with the degassing fuel, wherein the adsorption filter is purged and, in this context, the degassing fuel removed from the adsorption filter over a predefined time span is recorded;

determining, from at least one of the absorption capacity, the absorption characteristics of the adsorption filter, the loading factor, a recorded, removed fuel quantity and a changing at the loading, a quantity of the degassing fuel supplied to the adsorption filter from the fuel container over the predefined time span; and performing, as a function of a determined quantity of the degassing fuel supplied to the adsorption filter, at least one of: (i) one of an interrupting and a blocking of at least one tank leakage diagnosis function, and (ii)a correcting of the data as to an actual tank degassing ascertained with the at least one tank leakage diagnosis function, wherein one of the following is satisfied:(i) the at least one tank leakage diagnosis function is one of interrupted and blocked only when a determined quantity of the degassing fuel supplied to the adsorption filter exceeds a predefinable threshold value; and (ii) the data with respect to the actual tank degassing, ascertained with the at least one tank leakage diagnosis function, is corrected only when the determined quantity of the degassing fuel supplied to the adsorption filter exceeds a predefinable threshold value.

3. The method of claim 1, wherein the degassing fuel removed from the adsorption filter over the predefined time span is recorded in an integrating manner.

4. A method for operating a tank leakage diagnosis device in a motor vehicle, for testing a fuel container, which is connected to an internal combustion engine, for tightness, the method comprising:

regenerating an adsorption filter from time to time by purging by fresh air drawn in by the internal combustion engine, wherein degassing fuel is temporarily stored with an adsorption filter having at least one of an adsorption capacity and adsorption characteristics, the adsorption filter being connected to the fuel container;

providing a loading factor specifying the loading of the adsorption filter with the degassing fuel, wherein the adsorption filter is purged and, in this context, the degassing fuel removed from the adsorption filter over a predefined time span is recorded;

determining, from at least one of the absorption capacity, the absorption characteristics of the adsorption filter, the loading factor, a recorded, removed fuel quantity and a changing at the loading, a quantity of the degassing fuel supplied to the adsorption filter from the fuel container over the predefined time span; and performing, as a function of a determined quantity of the degassing fuel supplied to the adsorption filter, at least one of: (i) one of an interrupting and a blocking of at least one tank leakage diagnosis function, and (ii)a correcting of the data as to an actual tank degassing ascertained with the at least one tank leakage diagnosis function, wherein a balance equation of the form AKF_HC-loading=the integral(tank_HC-loading)—the integral (AKF_HC-venting) is used to determine the loading factor.

5. A method for operating a tank leakage diagnosis device in a motor vehicle, for testing a fuel container, which is connected to an internal combustion engine, for tightness, the method comprising:

regenerating an adsorption filter from time to time by purging by fresh air drawn in by the internal combustion engine, wherein degassing fuel is temporarily stored with an adsorption filter having at least one of an adsorption capacity and adsorption characteristics, the adsorption filter being connected to the fuel container;

providing a loading factor specifying the loading of the adsorption filter with the degassing fuel, wherein the adsorption filter is purged and, in this context, the degassing fuel removed from the adsorption filter over a predefined time span is recorded;

determining, from at least one of the absorption capacity, the absorption characteristics of the adsorption filter, the loading factor, a recorded, removed fuel quantity and a changing at the loading, a quantity of the degassing fuel supplied to the adsorption filter from the fuel container over the predefined time span; and performing, as a function of a determined quantity of the degassing fuel supplied to the adsorption filter, at least one of: (i) one of an interrupting and a blocking of at least one tank leakage diagnosis function, and (ii)a correcting of the data as to an actual tank degassing ascertained with the at least one tank leakage diagnosis function, wherein an exceeding of a defined threshold is assumed to be satisfied until it is possible to determine the quantity of the degassing fuel within a predefined tolerance during operation of the internal combustion engine.

6. A method for operating a tank leakage diagnosis device in a motor vehicle, for testing a fuel container, which is connected to an internal combustion engine, for tightness, the method comprising:

regenerating an adsorption filter from time to time by purging by fresh air drawn in by the internal combustion engine, wherein degassing fuel is temporarily stored with an adsorption filter having at least one of an adsorption capacity and adsorption characteristics, the adsorption filter being connected to the fuel container;

providing a loading factor specifying the loading of the adsorption filter with the degassing fuel, wherein the adsorption filter is purged and, in this context, the degassing fuel removed from the adsorption filter over a predefined time span is recorded;

determining, from at least one of the absorption capacity, the absorption characteristics of the adsorption filter, the loading factor, a recorded, removed fuel quantity and a changing at the loading, a quantity of the degassing fuel supplied to the adsorption filter from the fuel container over the predefined time span; and performing, as a function of a determined quantity of the degassing fuel supplied to the adsorption filter, at least one of: (i) one of an interrupting and a blocking of at least one tank leakage diagnosis function, and (ii)a correcting of the data as to an actual tank degassing ascertained with the at least one tank leakage diagnosis function, wherein a quantity of temporarily stored degassing fuel removed from the adsorption filter by purging is ascertained from at least one of: (i) a fuel quantity required for combustion is determined in a load sensing of the internal combustion engine, and (ii) by taking, as a basis, a mixture correction factor resulting from a lambda regulation.

7. A method for operating a tank leakage diagnosis device in a motor vehicle, for testing a fuel container, which is connected to an internal combustion engine, for tightness, the method comprising:

regenerating an adsorption filter from time to time by purging by fresh air drawn in by the internal combustion engine, wherein degassing fuel is temporarily stored with an adsorption filter having at least one of an adsorption capacity and adsorption characteristics, the adsorption filter being connected to the fuel container;

providing a loading factor specifying the loading of the adsorption filter with the degassing fuel, wherein the adsorption filter is purged and, in this context, the degassing fuel removed from the adsorption filter over a predefined time span is recorded;

determining, from at least one of the absorption capacity, the absorption characteristics of the adsorption filter, the loading factor, a recorded, removed fuel quantity and a changing at the loading, a quantity of the degassing fuel supplied to the adsorption filter from the fuel container over the predefined time span; and performing, as a function of a determined quantity of the degassing fuel supplied to the adsorption filter, at least one of: (i) one of an interrupting and a blocking of at least one tank leakage diagnosis function, and (ii)a correcting of the data as to an actual tank degassing ascertained with the at least one tank leakage diagnosis function, wherein the quantity of the degassing fuel is recorded only at sufficiently constant operating conditions of the internal combustion engine.

8. The method of claim 1, wherein a value of the loading factor of the adsorption filter is low-pass filtered.

9. A control apparatus for operating a tank leakage diagnosis device in a motor vehicle, for testing a fuel container, which is connected to an internal combustion engine, for tightness, degassing fuel being temporarily stored with an adsorption filter that has at least one of an adsorption capacity and adsorption characteristics, connected to the fuel container, comprising:

a regenerating arrangement to regenerate the adsorption filter from time to time by purging fresh air drawn in by the internal combustion engine;

a loading factor arrangement to provide a loading factor specifying a loading of the adsorption filter with the degassing fuel;

a recording arrangement to record engine characteristics data and the loading of the adsorption filter with the degassing fuel, and for calculating the degassing fuel supplied to the adsorption filter from the degassing fuel removed from the adsorption filter and the loading; and an arrangement for one of: (i) one of blocking and interrupting at least one tank leakage diagnosis function; and (ii) for correcting data as to an actual tank degassing, ascertained with at least one tank leakage diagnosis function, as a function of a determined quantity of degassing fuel supplied to the adsorption filter.

10. A control apparatus for operating a tank leakage diagnosis device in a motor vehicle, for testing a fuel container, which is connected to an internal combustion engine, for tightness, degassing fuel being temporarily stored with an adsorption filter that has at least one of an adsorption capacity and adsorption characteristics, connected to the fuel container, comprising:

a regenerating arrangement to regenerate the adsorption filter from time to time by purging fresh air drawn in by the internal combustion engine;

a loading factor arrangement to provide a loading factor specifying a loading of the adsorption filter with the degassing fuel;

a recording arrangement to record engine characteristics data and the loading of the adsorption filter with the degassing fuel, and for determining calculating the degassing fuel supplied to the adsorption filter from the degassing fuel removed from the adsorption filter and the loading; and an arrangement for one of: (i) one of blocking and interrupting at least one tank leakage diagnosis function; and (ii) for correcting data as to an actual tank degassing, ascertained with at least one tank leakage diagnosis function, as a function of a determined quantity of degassing fuel supplied to the adsorption filter, wherein the blocking arrangement includes a comparing arrangement to compare a determined amount of emitted gas, supplied to the adsorption filter, to a predefined threshold value, and when the predefined threshold value is exceeded, performing the one of (i) the blocking and interrupting and (ii) the correcting.

11. The control apparatus of claim 9, further comprising:

a timer;

an integrator for integrating calculated values of the degassing fuel supplied to the adsorption filter; and a starting arrangement to actively start a purging of the adsorption filter.

12. A control apparatus for operating a tank leakage diagnosis device in a motor vehicle, for testing a fuel container, which is connected to an internal combustion engine, for tightness, degassing fuel being temporarily stored with an adsorption filter that has at least one of an adsorption capacity and adsorption characteristics, connected to the fuel container, comprising:

a regenerating arrangement to regenerate the adsorption filter from time to time by purging fresh air drawn in by the internal combustion engine; a loading factor arrangement to provide a loading factor specifying a loading of the adsorption filter with the degassing fuel;

a recording arrangement to record engine characteristics data and the loading of the adsorption filter with the degassing fuel, and for determining calculating the degassing fuel supplied to the adsorption filter from the degassing fuel removed from the adsorption filter and the loading;

an arrangement for one of: (i) one of blocking and interrupting at least one tank leakage diagnosis function; and (ii) for correcting data as to an actual tank degassing, ascertained with at least one tank leakage diagnosis function, as a function of a determined quantity of degassing fuel supplied to the adsorption filter; and a testing arrangement to test whether a calculation of the emitted gas removed from the adsorption filter is possible, based on recorded operating variables of the internal combustion engine.

13. The control apparatus of claim 9, further comprising:

a filtering arrangement to low-pass filter the recorded loading of the adsorption filter.

14. A tank leakage diagnosis apparatus comprising:

a tank leakage diagnosis device for a motor vehicle, for testing a fuel container, which is connected to an internal combustion engine, for tightness, the device performing the following:

regenerating an adsorption filter from time to time by purging by fresh air drawn in by the internal combustion engine, wherein degassing fuel is temporarily stored with an adsorption filter having at least one of an adsorption capacity and adsorption characteristics, the adsorption filter being connected to the fuel container;

providing a loading factor specifying the loading of the adsorption filter with the degassing fuel, wherein the adsorption filter is purged and, in this context, the degassing fuel removed from the adsorption filter over a predefined time span is recorded;

calculating, from at least one of the absorption capacity, the absorption characteristics of the adsorption filter, the loading factor, a recorded, removed fuel quantity and a changing at the loading, a quantity of the degassing fuel supplied to the adsorption filter from the fuel container over the predefined time span; and performing, as a function of a determined quantity of the degassing fuel supplied to the adsorption filter, at least one of: (i) one of an interrupting and a blocking of at least one tank leakage diagnosis function, and (ii)a correcting of the data as to an actual tank degassing ascertained with the at least one tank leakage diagnosis function.

15. A tank leakage diagnosis apparatus comprising:

a control apparatus to control a diagnosing of a tank leakage in a motor vehicle, for testing a fuel container, which is connected to an internal combustion engine, for tightness, degassing fuel being temporarily stored with an adsorption filter that has at least one of an adsorption capacity and adsorption characteristics, the adsorption filter being connected to the fuel container, the control apparatus including:

a regenerating arrangement to regenerate the adsorption filter from time to time by purging fresh air drawn in by the internal combustion engine;

a loading factor arrangement to provide a loading factor specifying a loading of the adsorption filter with the degassing fuel;

a recording arrangement to record engine characteristics data and the loading of the adsorption filter with the degassing fuel, and for calculating the degassing fuel supplied to the adsorption filter from the degassing fuel removed from the adsorption filter and the loading; and an arrangement for one of: (i) one of blocking and interrupting at least one tank leakage diagnosis function; and (ii) for correcting data as to an actual tank degassing, ascertained with at least one tank leakage diagnosis function, as a function of a determined quantity of degassing fuel supplied to the adsorption filter.

* * * * *